United States Patent [19]

Albright et al.

[11] Patent Number: 4,744,175

[45] Date of Patent: May 17, 1988

[54] VENDING MACHINE DOOR CLOSURE MECHANISM

[75] Inventors: Henry J. Albright, West Des Moines; Paul L. Hawkins; Randy E. Harwood, both of Guthrie Center, all of Iowa

[73] Assignee: Fawn Engineering Corp., Des Moines, Iowa

[21] Appl. No.: 900,180

[22] Filed: Aug. 25, 1986

[51] Int. Cl.[4] ..... E05D 11/00

[52] U.S. Cl. ..... 49/383; 221/281; 194/350; 312/138 R

[58] Field of Search ..... 312/138 A, 138 R, 139, 312/215; 49/50, 56, 383; 221/281; 194/350

[56] References Cited

U.S. PATENT DOCUMENTS

| | | | |
|---|---|---|---|
| 1,101,960 | 1/1914 | Roberti | 49/383 |
| 3,000,539 | 9/1961 | Danziger et al. . | |
| 3,269,595 | 8/1966 | Krakauer et al. . | |
| 3,319,697 | 5/1967 | Krohn | 40/383 |
| 3,335,907 | 8/1967 | Holstein et al. . | |
| 3,367,730 | 2/1967 | Andrews et al. . | |
| 3,613,187 | 5/1967 | Mullen | 312/138 R |
| 3,680,937 | 8/1972 | Steeley | 312/138 |
| 3,993,215 | 11/1976 | Cox et al. . | |
| 4,103,458 | 8/1978 | Booker | 49/56 |

*Primary Examiner*—Kenneth J. Dorner
*Assistant Examiner*—Gerald A. Anderson
*Attorney, Agent, or Firm*—Henderson & Sturm

[57] ABSTRACT

A vending machine (21) door closure mechanism (20) for providing pivotal movement of the door (52) from a closed position for vending purposes to an open position of approximately 100°-110° wherein the interior of the cabinet is accessible and one or more shelves (27) can be withdrawn, the closure mechanism (20) comprising a plate (66) secured to the top of the cabinet (22) and with a portion (69) extended forwardly beyond the front face (71) of the door (52); a flange (74) secured to the top of the door (52) and underlying the plate (66) with a pin (78) pivotally securing the plate (66) and the flange (74) together; and a panel (79) forming one end of the door (52), the panel (79) forming a relatively movable interlocking relationship at one vertical edge (81) with a corner (82) of the cabinet (22) and having a hinged relationship provided by a hinge (91) with an outer corner (70) of the door (52), the end panel (79) movably maintaining its closure position with the door (52) and cabinet (22) while the door (52) is swung openly; the door (52) capable of being swung to an approximate 270° position up against the sidewall (23) of the cabinet (22) due to the temporary removal of a guard plate (93) which normally prevents the closure panel (79) from swinging free and out of its normal interlocking relationship.

5 Claims, 3 Drawing Sheets

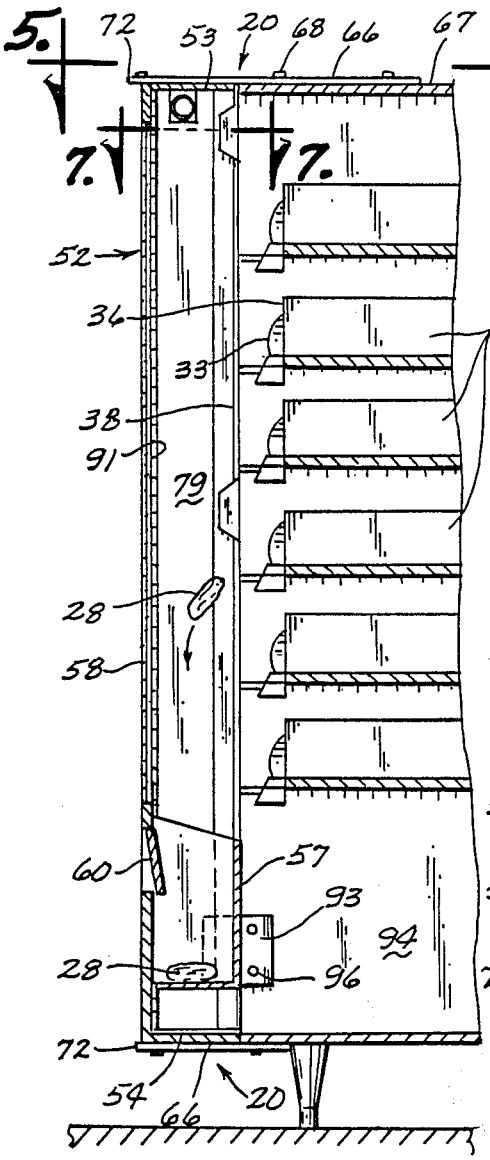
Fig. 4
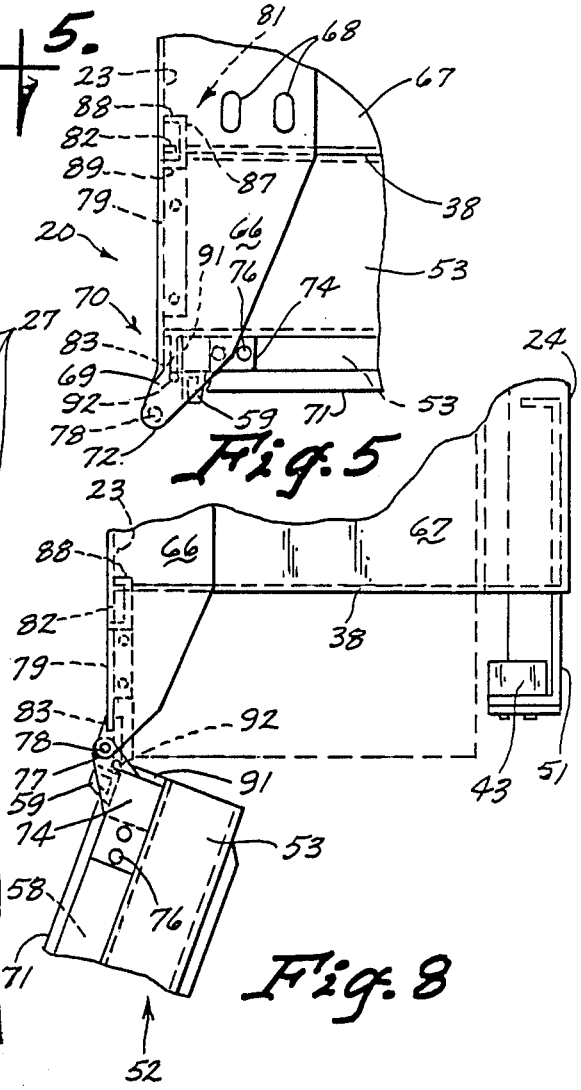
Fig. 5
Fig. 8
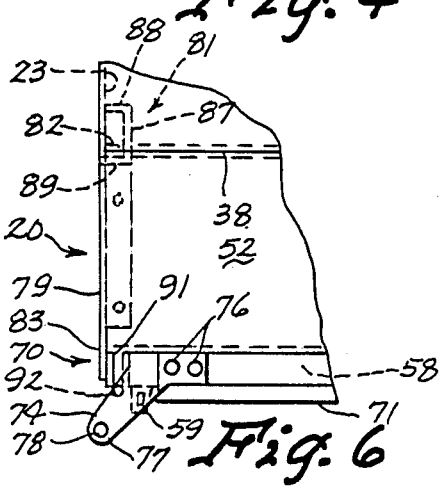
Fig. 6
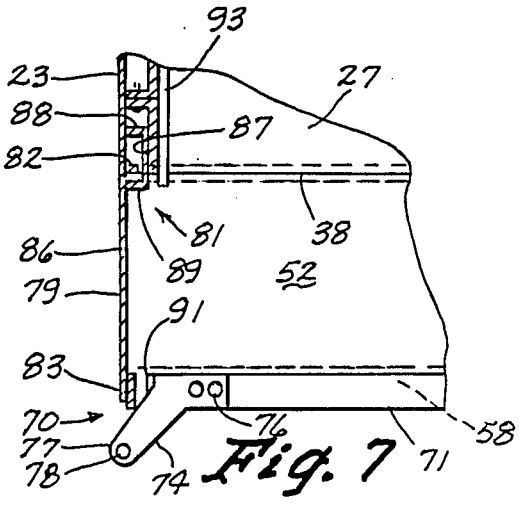
Fig. 7

VENDING MACHINE DOOR CLOSURE MECHANISM

TECHNICAL FIELD

The present invention relates generally to an article vending machine, and more particularly to an improved door closure mechanism therefor.

BACKGROUND ART

The present invention relates to article vending machines comprising generally a cabinet for housing a plurality of vertically stacked, generally horizontally disposed and movable trays or shelves for holding products to be vended. Each shelf includes a plurality of longitudinally extended, parallel helical feeder coils mounted in individual troughs, rotation of a coil advancing product interposed between the convolutions of the coils to a delivery opening. Each shelf is movable from an inner vending position to an outwardly extended position, the shelf extended beyond the open face of the cabinet for ease of servicing and loading products.

The machine includes further a door, normally with a glass front insert, which door usually carries a product delivery drawer with an anti-theft structure, and a coin discharge unit; thus, the door has substantial depth. Trim is normally mounted about the face of the door for aesthetic purposes.

With this conventional machine available, several requirements of the industry and marketplace place rigid and demanding conditions on the design of the machine. A shelf must be pulled out sufficiently far enough to load the rear of the shelf with new products. This requires the door to be swung sufficiently about its pivot to enable the shelf to clear the door structure. The degree of door opening, however, is limited by the placement of the machine relative to a wall or other structure, such as another vending machine. The consuming public is familiar with a plurality of vending machines placed side-by-side in contacting engagement virtually from wall to wall in a public or corporate-type lunch room. The close proximity of the machines is such that even the depth of the door trim may present problems with respect to space limitations.

Several structural arrangements have been devised in attempts to solve these problems, including changing the depths of the door, changing the pivot point for the door, and even having a pivot point within the vertical trim; however, none of the present structures solve all of the problems attendant with fulfilling all of the conditions. For example, one solution involved retaining the hinged side wall of the door in place and in a coupled engagement with the cabinet corner. This provided, however, an opening for the insertion of a pry bar or the like in the coupled hinge by thieves, anti-thievery provisions being a necessity in vending machines due to their exposure to the public at all times of the day and in many non-protected areas.

Another condition is the capability of the vending machine being moved through doors of conventional width. A variety of arrangements have been tried, one being to recess the tray area for maneuvering the machine through a doorway. Due primarily to the need to limit the degree of opening of the door, this type of effort has had only limited success.

DISCLOSURE OF THE INVENTION

The invention relates to an improved door closure mechanism for a vending machine having horizontally movable product vending shelves which require partial extraction from the machine for servicing, which vending machine door has a depth of sufficient amount to accommodate an anti-theft delivery drawer.

The improved door closure comprises the provision of a pair of pivots for hingedly opening the door at one corner of the cabinet, one of the pivots being located within an outer stationary pivot and movable arcuately inside of and about the stationary pivot relative to the machine. To enclose the non-opening end of the door, a movable closure panel is provided, one end of which is hingedly connected to a clasp hinge which comprises the inner, movable pivot, the other end being free but movably interconnected with a corner element of the cabinet, sufficient movement being provided for accommodating the arcuate movement of the clasp hinge as the door is swung open.

Guide plates are mounted on the cabinet face for normally maintaining the free end of the closure panel in its interlocked position; however, by the temporary separation of one of the guide plates, the closure panel is freed from its cabinet interlocked condition such that the door can then be swung approximately 270° about the stationary pivot to a position substantially flush with the adjacent side of the cabinet. This places the machine in condition for transportation through narrow doorways and the like. When the machine is again located for normal use, upon closure of the door and re-engagement of the closure panel with its normal interlocking engagement with the cabinet corner element, the separated guide plate is re-secured to the cabinet and the entire machine is ready for normal vending operation.

It is an object of this invention to provide a new and unique door closure mechanism for a vending machine.

It is another object of this invention to provide an improved door closure mechanism which mechanism for a vending machine of the type shown herein will provide for the shelves to be pulled outwardly of the cabinet with the door open to not more than 100°-110° from its initial closed position.

Yet another object of this invention is to provide a new door closure mechanism for a vending machine of the type shown herein which, when open to approximately 100°-110° does not place any obstruction to the placement of the machine flush against a like machine, a wall or the like.

Still another object of this invention is to enable the vending machine door to be swung open approximately 270° with a minimum of effort, thereby rendering the machine much more capable of movement through narrow openings.

It is another object of this invention to achieve all of the aforementioned objectives while maintaining the improved door closure mechanism against breaking and entering the machine as by a pry bar or the like through the door closure mechanism.

BRIEF DESCRIPTION OF THE DRAWINGS

These and other objectives of the invention will become readily apparent upon a thorough study and review of the following detailed description of the preferred embodiment for carrying out the invention, particularly when viewed in conjunction with the accompanying drawings, wherein:

FIG. 4 is a vertical cross-sectional view of the door taken the line 4—4 in FIG. 2;

FIG. 5 is a plan, fragmentary view of the top of the door and cabinet at the door closure mechanism area, as seen along line 5—5 in FIG. 4;

FIG. 6 is a view similar to FIG. 5, but with certain parts broken away;

FIG. 7 is a view similar to FIGS. 5 and 6 and with additional parts removed;

FIG. 8 is a reduced top plan view with the door open to an approximate 100° position and with a shelf pulled partially out;

PREFERRED EMBODIMENT OF THE INVENTION

Figure 2:
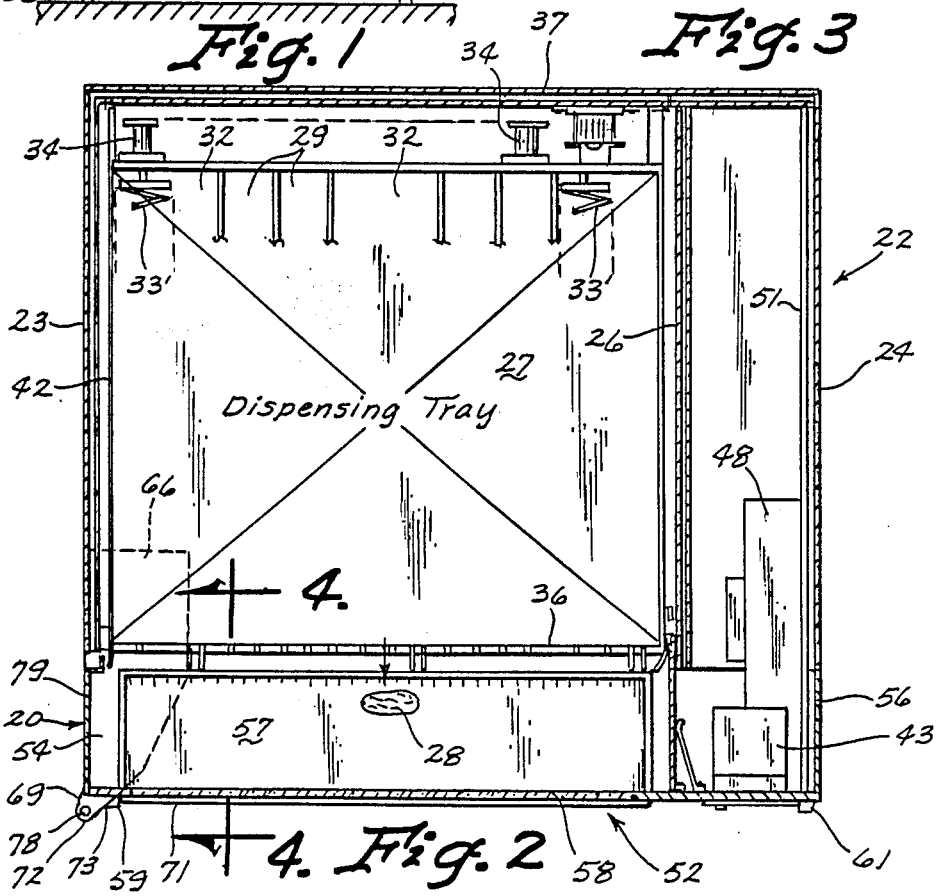
FIG. 2 is an enlarged, horizontal cross-sectional view taken al the line 2—2 in FIG. 1.
Figure 9:
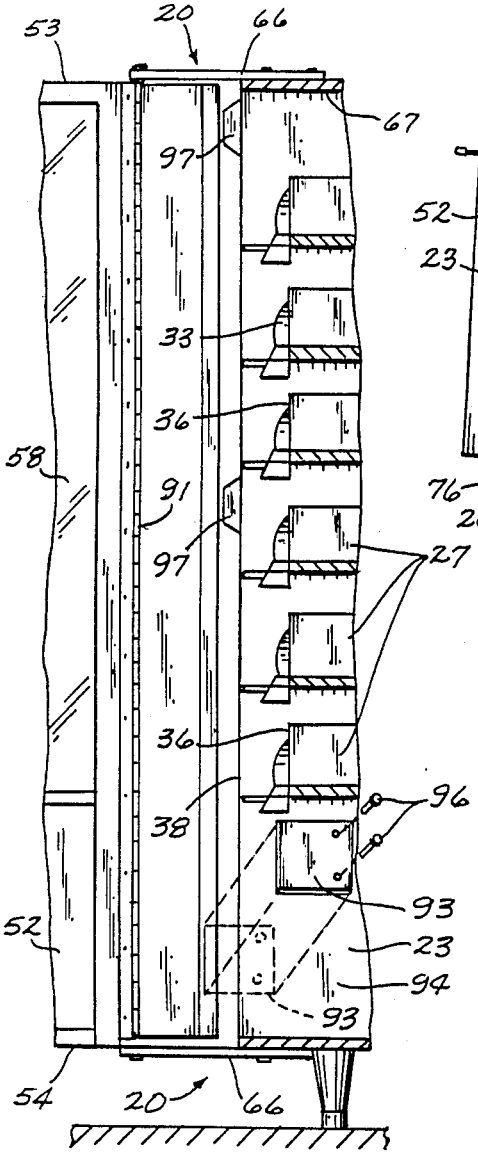
FIG. 9 is a vertical sectional view taken along the line 4—4 in FIG. 2.

Referring to the drawings, a novel and unique door closure mechanism is illustrated generally at (20) in FIG. 2 as part of a vending machine, indicated generally at (21). The vending machine (21) has a cabinet (22) open at the front end and with laterally spaced sidewalls (23) and (24), an inner sidewall (26) also laterally spaced from opposite sidewall (23) to form a cavity for a plurality of horizontally disposed shelves (27) each of which carries product (28) (FIGS. 2 and 4) to be vended therefrom.

Each shelf (27) has a plurality of troughs (29), (31), etc. (FIG. 2) formed by dividers (32), and with a helical feeder coil (33) (33') mounted within each trough (29), (31). Rotation of a feeder coil (33) by customer selection of a selected drive unit (34) for each coil (33) causes advancement of a product (28) carried within the convolutions of the coil (33) forwardly until discharged beyond the front end (36) (FIG. 4) of a shelf, the product (28) falling downwardly for delivery.

It will be noted that a product dispensing tray or shelf (27) (FIG. 2) encompasses substantially all of the horizontal space encompassed laterally between the sidewalls (23), (26), and depthwise between the rear cabinet wall (37) and the front (38) (FIG. 8) of the cabinet as extended between the front corners (39) ahd (41) of the cabinet (22). For example, as viewed in FIG. 2, the left side (42) of the shelf (27) is closely adjacent and disposed parallel to the left sidewall (23) of the cabinet (22). The shelves (27) are movable by the operator from an inner vending position completely within the cabinet (22) (FIG. 2) to a position extended at least partially outwardly of and through the cabinet front, as shown by dotted lines in FIG. 8, the extended position for servicing and product loading purposes by the operator.

Figure 1:
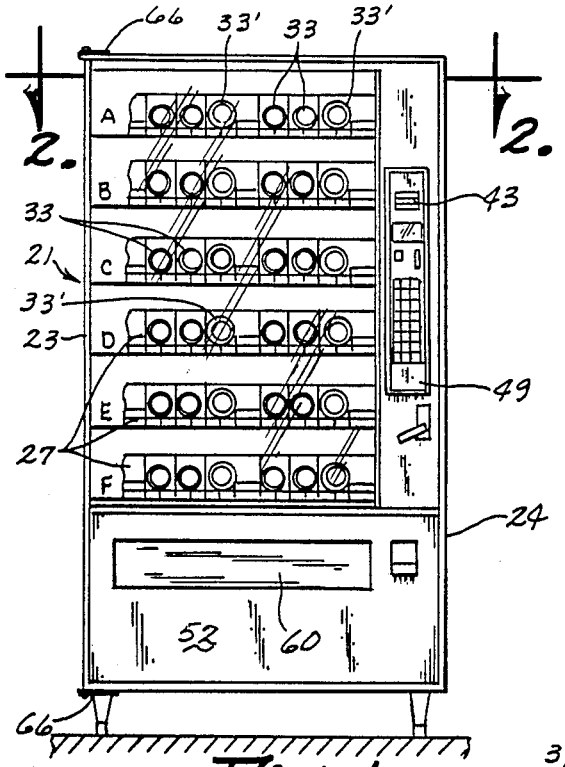
FIG. 1 is a front elevational view of a vending machine embodying the present invention.
Figure 3:
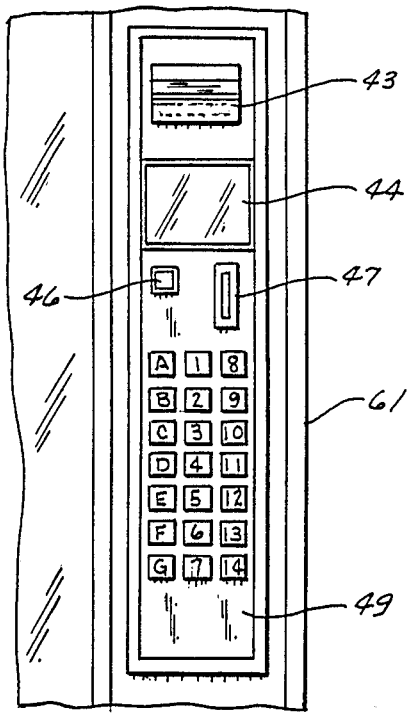
FIG. 3 is an enlarged detail front elevational view of the control panel.

Referring to FIGS. 1-3, although not a part of this invention, the cabinet includes further a grouping of control equipment, including a dollar bill validator (43), light emitting diode unit (44) for customer information and operator service diagnostic purposes, coin return switch (46), coin insert (47) for coin handling mechanism (48). A membrane switch product selector panel (49) is provided for product selection purposes, and behind which is mounted a microprocessor unit (not shown) for electronically selecting the particular product to be vended. The control equipment is mounted on a vertically disposed side element (51) which is slidably connected to the right sidewall (24) of the cabinet (22), whereby the entire aforementioned grouping of control equipment can be slid from a stored position (FIG. 8) to an extended position for improved servicing purposes.

The vending machine has further a box-like door unit indicated generally at (52), and includes a top panel (53) (FIG. 4), bottom panel (54), solid right side panel (56) as viewed in FIG. 2, and a product delivery drawer (57) with an anti-theft flap (60). A glass panel (58) is mounted in the face of the door (52) and vertically disposed strips of trim (59), (61) form the front corners of the door (52) (FIGS. 2 and 5).

The closure mechanism (20) of this invention is mounted at the top and bottom of the cabinet (22) and door (52) and only the top mechanism (20) will be described. It includes a flat plate (66) (FIG. 5) secured to the top wall (67) of the cabinet (22) by fasteners (68) and a triangular portion (69) of which extends forwardly over the top (53) of the door (52) at one corner thereof indicated generally at (70) and slightly beyond the face (71) thereof. It will be noted the forward edge (72) of the plate (66) is slightly forward than the forward face (73) of the adjacent trim strip (59).

Additionally, the closure mechanism (20) includes a flat flange (74) secured by fasteners (76) to the top panel (53) of the door adjacent the corner (70), and with a portion (77) of the flange (74) extended beneath the plate triangular portion (69), the two portions (69) and (77) pivotally connected together at (78). The pivot (78) is located slightly forwardly of the door face (71) (FIG. 5) and substantially on-line with the adjacent cabinet sidewall (23). It will be noted that the pivot (78) is slightly forward of the trim strip outer face (73).

Further, the closure mechanism (20) includes a substantially rectangular panel (79) (FIGS. 5-9) having a length substantially equal the height or length of the door (52) and forming one end of the door (52). The closure panel (79) has a movable interlocking relationship at one side edge (81) thereof with an adjacent corner angle portion (82) (FIG. 6) of the cabinet (22), and has a hinged relationship at the opposite side edge (83) with an outer corner edge (70) of the door (52). By this arrangement, upon movement of the door (52) from a closed position (FIG. 5) to an open position (FIG. 7), the closure panel (79) is movable relative to the cabinet angle portion (82) while maintaining its interlocked relationship with the door (52). Further, the closure panel (79) acts at all times as a closed end of the door (52) at the hinged end thereof (FIGS. 5-7), and prevents normal access to the interior of the cabinet through that end of the door (52).

More particularly, the closure panel (79) in cross-section has a flat portion (86) (FIG. 7) extended inwardly from the hinged edge (83), with an integral, outwardly facing U-shaped portion (87) extended further inwardly, and encompassing the cabinet angle portion (82). The panel flat portion (86) extends substantially in-line with the side (23) of the cabinet (22). By providing sufficient longitudinal distance between the legs (88), (89) of the portion (87), the entire panel (79) may move or shift longitudinally back and forth relative to the angle portion (82), and due to swinging movement of the door (52). With the hinged connection, a strap hinge (91) (FIG. 9) in this instance, forming a second pivot (92) (FIG. 6) relative to the first pivot (78), which second pivot (92) is at the outermost corner of the door (52) as viewed in FIGS. 5–7, and which second pivot (92) lies inside of the first pivot (78) relative to the remainder of the cabinet (22) and door (52), it will be readily apparent upon swinging movement of the door (52) that the hinged pivot (92) moves arcuately about the pivot (78), thus causing longitudinal movement with a slight lateral movement of the closure panel (79), all provided by the interlocking arrangement of the panel (79) which provides sufficient freedom for such movements.

The closure mechanism (20) provides further for swinging the door (52) to a position 100°–110° from its closed position (FIG. 8) such that any of the shelves (27) can be moved to their extended position (FIG. 8) for servicing, such operation provided without manipulating any of the components. However, further swinging movement is permitted by removal of a lower guard plate (93) (FIGS. 4 and 9), secured to an interior wall (94) of the cabinet (22) by fasteners (96), and extended parallel the outer wall (23) so as to embrace the U-shaped portion (87) of the closure panel (79) (FIG. 6) at all times. Other similar guard plates(97) (FIG. 9) are also provided; however, these plates (97) do not extend forwardly sufficient to embrace the U-shaped portion (87) enough to prevent its swinging completely away from its interlocked arrangement.

Figure 10:
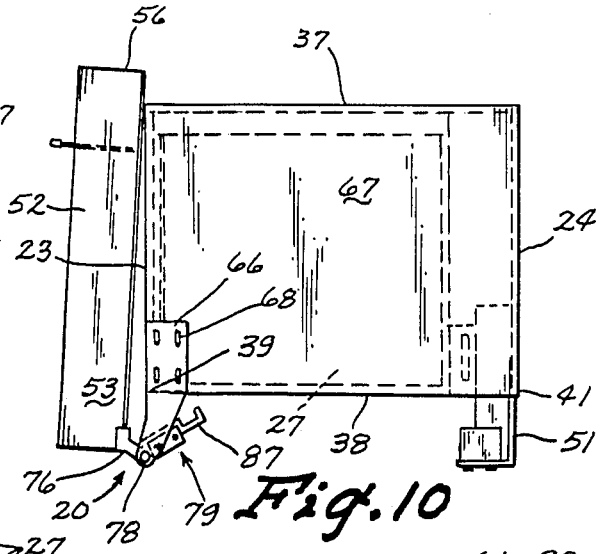
FIG. 10 is a view similar to FIG. 8 and with the door moved to approximate 270° position.
Figure 11:
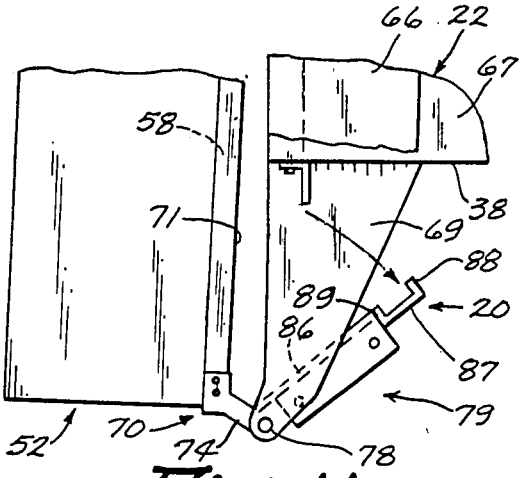
FIG. 11 is an enlarged fragmentary plan view of the door closure mechanism detail of FIG. 10, showing the closure panel in a free condition.
Figure 12:
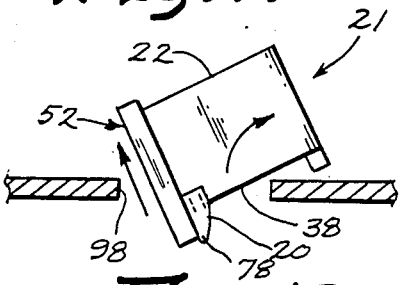
FIG. 12 is a schematic drawing of the vending machine of this invention having its door in the FIG. 10 position and being moved through a doorway.

The removal of the lower guard plate (93) thus frees the hinged closure panel (79), preventing its being sprung upon opening of the door (52) beyond the 100°–110°, and as shown in FIGS. 10 and 11 the door (52) can then be swung to a position wherein it is closeable against the outer side of the cabinet wall (23) and substantially flush therewith (FIGS. 10 and 11). As illustrated in FIG. 11, by opening up the front of the cabinet (22), which has a U-shape due to the inset nature of the shelves (27), and by swinging the door (52) to the fully open position wherein it extends the width of the cabinet (22) while only increasing the depth slightly at one end, the entire vending machine (21) is readily and easily moved through a doorway (98) more narrow than the width or length of the closed machine (21).

We claim:

1. In a vending machine having a cabinet open at the front and having laterally spaced sidewalls, one or more product carrying and dispensing shelves movable from a position within the cabinet to a position extended at least partially outwardly of and through the cabinet front, a door having a face and a product delivery drawer secured to its inner lower side for receiving product vended from one of the shelves, the door pivotally movable from one position closing the cabinet open front to another position wherein the interior of the cabinet is accessible, an improved door closure mechanism comprising:

plate means secured to the cabinet and extended over the door adjacent an outer corner thereof;

flange means secured to the door and pivotally connected to said plate means at a first pivot point adjacent said outer corner; and panel means having a length substantially equal that of the door and forming one end of the door adjacent said outer corner, said panel means extended at right angles to the width of said door having a movable interlocking relationship at one side edge thereof with the cabinet and having a hinged connection at an opposite side edge thereof with an edge of said door at said outer corner, whereby upon movement of the door from a closed position to an open position said panel means is movable relative to the cabinet while maintaining its interlocked relationship therewith and preventing normal access to the interior of the cabinet through said door at that said end thereof;

and further wherein said plate means comprises a plate secured to the cabinet and extended forwardly thereof over the door, said plate extends forwardly beyond the face of the door;

said panel means comprises a substantially rectangular panel having a length substantially equal that of the door, said panel having a relatively flat portion intermediate said opposed side edges which portion is disposed in-line with the adjacent sidewall of the cabinet;

said hinged connection forms a second pivot point, also at said outer corner and which moves arcuately about said first pivot point upon movement of the door.

2. The invention of claim 1 and further wherein said first pivot point is substantially aligned with the longitudinal extent of the adjacent cabinet sidewall.

3. The invention of claim 1 and further wherein guard plate means is removably secured to the cabinet adjacent said one corner and in spaced relationship laterally from said panel means one side edge, and extended generally parallel thereto whereby said panel means is freely movable generally longitudinal relative to said guard plate means but with limited lateral movement between the cabinet and said guard plate means.

4. The invention of claim 3 and further wherein said door is swingable to an open position approximately 100° from the closed position of said door, whereby one of the shelves is movable to its extended position.

5. The invention of claim 3 and further wherein upon removal of said guard plate means, the door is swingable from its closed position approximately 270° to a position against the outer side of the cabinet sidewall adjacent said one corner.

* * * * *